United States Patent [19]

Males

[11] 4,039,113

[45] Aug. 2, 1977

[54] PNEUMATICALLY OPERATED FASTENER DRIVING DEVICE WITH IMPROVED MAIN VALVE ASSEMBLY

[75] Inventor: Robert E. Males, Cranston, R.I.

[73] Assignee: Textron, Inc., Providence, R.I.

[21] Appl. No.: 677,783

[22] Filed: Apr. 16, 1976

[51] Int. Cl.[2] ..... B25C 1/04

[52] U.S. Cl. ..... 227/130

[58] Field of Search ..... 227/130

[56] References Cited

U.S. PATENT DOCUMENTS

| | | | |
|---|---|---|---|
| 3,106,134 | 10/1963 | Osborne | 227/130 |
| 3,200,716 | 8/1965 | LaSage | 227/130 |
| 3,871,566 | 3/1975 | Ellieson et al. | 227/130 |

*Primary Examiner*—Granville Y. Custer, Jr.
*Attorney, Agent, or Firm*—Cushman, Darby & Cushman

[57] ABSTRACT

A pneumatically operated fastener driving device having an improved main valve assembly including separate inlet and outlet valve structures and a spring operatively connected with the inlet and outlet valve structures for effecting (1) a movement of the outlet valve structure from the open position thereof to the closed position thereof simultaneously with a movement of the inlet valve structure from the closed position thereof to the open position thereof; and (2) a movement of the outlet valve structure from the closed position thereof to the open position thereof sequentially following a movement of the inlet valve structure from the open position thereof to the closed position thereof.

10 Claims, 5 Drawing Figures

PNEUMATICALLY OPERATED FASTENER DRIVING DEVICE WITH IMPROVED MAIN VALVE ASSEMBLY

This invention relates to fastener driving devices and more particularly to devices of this type adapted to be operated by fluid under pressure.

Pressure operated fastener driving devices are well known and their use is increasing. A typical device of this type includes a portable housing defining a guide track, a magazine assembly for feeding successive fasteners laterally into the guide track, a fastener driving element slidable in the drive track, a piston and cylinder unit for moving the fastener driving element through a cycle which includes a drive stroke and a return stroke, a main valve assembly for controlling the communication of the cylinder with air under pressure communicated with the device and with the atmosphere to effect the cycling and a manually operable valve for controlling the main valve assembly through pilot pressure.

A commonly used main valve means is disclosed in Goldring U.S. Pat. No. 3,035,268 as a simple one-piece valve member movable between two limiting positions. In one position of the main valve member, the cylinder inlet is closed and the exhaust port is opened while in the other the cylinder inlet is opened while the exhaust port is closed. In actual operation, a drive stroke is initiated by initiating the movement of the main valve member from its inlet closing position toward its inlet opening position. With the simple one-piece valve member arrangement, an optimum communication of the driving pressure with the piston is obtained since such communication begins with the beginning of the movement of the valve member. It will be noted, however, that the closing of the exhaust port does not occur until the completion of the movement of the valve member which may be considered to require some finite amount of time even though exceedingly small. Likewise, the return stroke is initiated by initiating the movement of the main valve member from its inlet opening position toward its inlet closing position. During this movement the exhaust port is opened initially and the inlet is not closed until the completion of the valve member movement, which, again, must be considered to require a finite amount of time.

The time required to complete a movement of the main valve is dependent upon the various biasing forces involved including the pilot pressure conditions. Usually, the pilot pressure conditions are chosen such that the inlet opening movement of the main valve is accomplished most rapidly which means that the reverse pilot pressure condition cannot be accomplished with the same rapidity. Consequently, it is well known that, due to the less rapid inlet closing movement of the main valve member, some pressure is lost through the opening of the exhaust port before the inlet is closed. Where the tool involved is of high capacity such air loss can be appreciable.

It has long been known that the air losses discussed above can be eliminated by utilizing a main valve means which embodies separate inlet and exhaust valve members which are moved in sequence. See, for example, Osborne U.S. Pat. No. 2,960,067. A typical arrangement of this type will close the inlet valve member before opening the exhaust member, thus eliminating the condition which caused the air losses mentioned above. Sequencing valve arrangements such as disclosed in the Osborne patent also inherently provide for the reverse sequence in the opposite direction so that the actual initiation of the drive stroke is delayed the finite amount of time required to close the exhaust port before opening the inlet. While such delay may actually improve the overall efficiency of the tool, it makes the tool seem less responsive and less powerful from a subjective point of view to the operator and hence sequential valving has not generally been utilized.

An object of the present invention is the provision of a fastener driving device of the type described having an improved main valve means which is operable to initiate the drive stroke with a direct action such as is desirably provide by conventional one-piece valve members while at the same time being operable to sequentially initiate the return stroke and thus eliminate the air losses heretofore occasioned by the non-sequential initiation of the return stroke by conventional one-piece valve members. The present invention thus provides for the elimination of the simple one-piece losses heretofore associated with simpleone-piece main valve construction without the attendant subjective non-responsiveness heretofore associated with two-way sequencing valves. In accordance with the principles of the present invention this objective is obtained by mounting the exhaust valve member so that it is moved into and maintained in its closed position by the movement of the inlet valve member from its closed position into its open position, by providing a spring bias for the exhaust valve member into its open position and opposed pressure responsive areas one of which acts against the spring bias and is communicated with the pressure of the cylinder at all times, the other of which is restrictingly communicated with atmosphere and by providing for the communication of the other pressure area with the pressure within the cylinder in response to the movement of the inlet valve member from its open position into its closed position. With this arrangement, the imbalance on the two pressure surface areas of the exhaust valve member will initially maintain it in its closed position as the inlet valve member is initially moved toward its closed position. This movement, however, has the effect of balancing the imbalance on the two opposed pressure areas so that the spring bias will move the exhaust valve into an open position immediately following the closing of the inlet valve member.

Another object of the present invention is the provision of a pneumatically operated fastener driving device of the type described having an improved main valve construction which provides for simultaneous opening of the inlet and closing of the outlet to initiate the drive stroke and sequential closing of the inlet and opening of the outlet to initiate the drive stroke, which valve construction is simple in operation and economical to manufacture and maintain.

These and other objects of the present invention will become more apparent during the course of the following detailed description and appended claims.

The invention may best be understood with reference to the accompanying drawings wherein an illustrative embodiment is shown. In the drawings.

Figure 1:
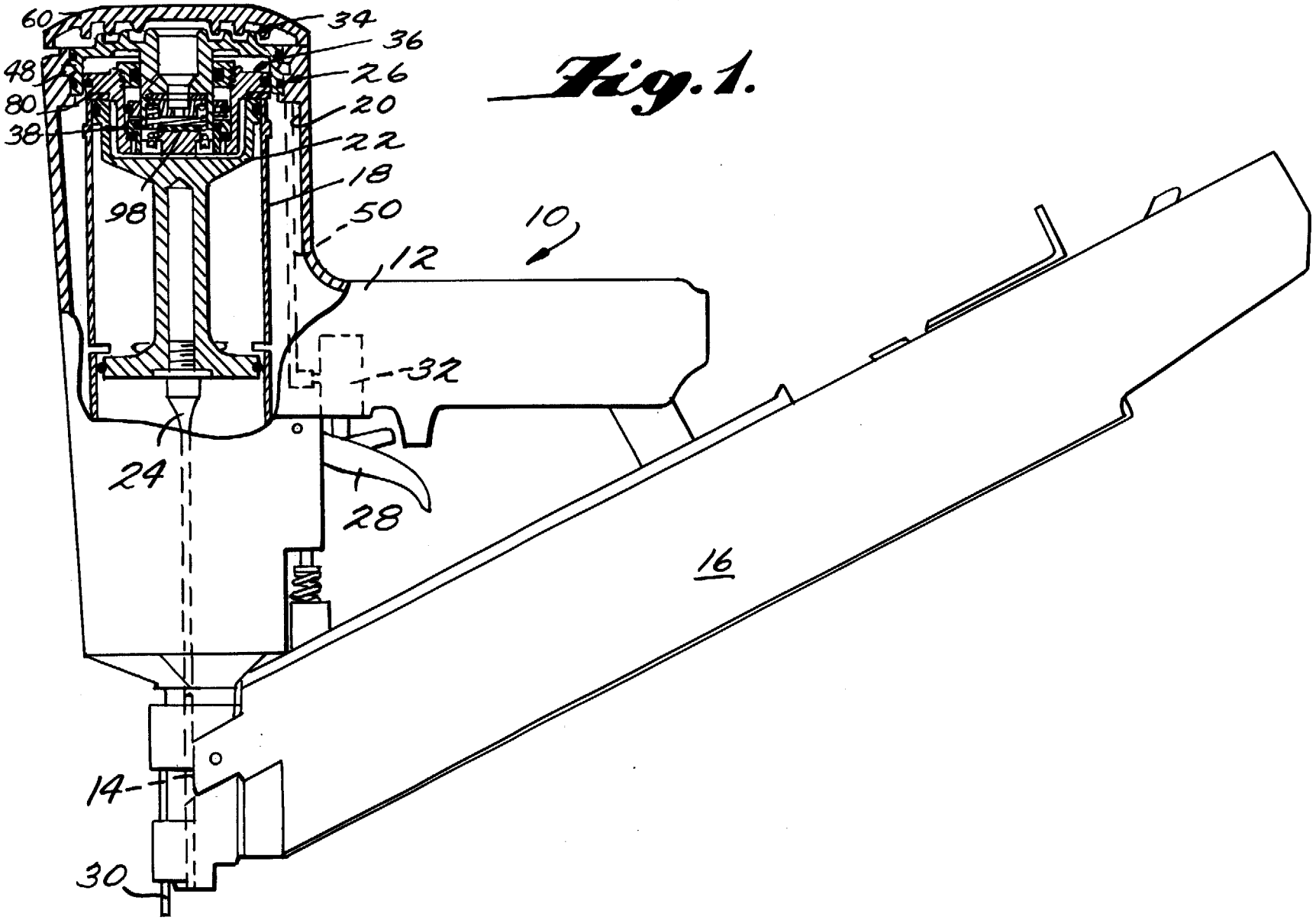
FIG. 1 is a side elevational view, with parts in section, of a pneumatically operated fastener driving device embodying the principles of the present invention.

Referring now more particularly to FIG. 1 of the drawings, there is shown therein a pneumatically operated fastener driving device, generally indicated at 10, which embodied the principles of the present invention. The device 10 includes the usual housing 12 providing a handle by which an operator is enabled to manually handle the device. The housing 12 includes the usual nosepiece defining a fastener drive track 14 which is adapted to receive laterally therein the leading fastener from a package of fasteners mounted within a magazine assembly, generally indicated at 16, of conventional construction and operation. Mounted within the housing 12 is a cylinder 18 which has its upper end disposed in communicating relation exteriorly with a reservoir chamber 20 within the housing which extends into the hollow handle thereof. Mounted within the cylinder 18 is a piston 22. In the arrangement shown, the cylinder 18 and piston 22 are a differential type unit, as is well known in the art. Carried by the piston 22 is a fastener driving element 24 which is slidably mounted within the drive track 14 and movable by the piston and cylinder unit through a cycle of operation which includes a drive stroke during which the fastener driving element 24 engages a fastener within the drive track 14 and moves the same longitudinally outwardly into a workpiece and in a return stroke. In order to effect the aforesaid cycle of operation, there is provided a main valve assembly, generally indicated at 26, constructed in accordance with the improvements of the present invention. The main valve assembly 26 is pilot pressure operated, the pilot pressure being under the control of a trigger 28 and contact trip 30 which serve to move a pilot pressure valve 32 in a manner which is well known in the art.

Figure 2:
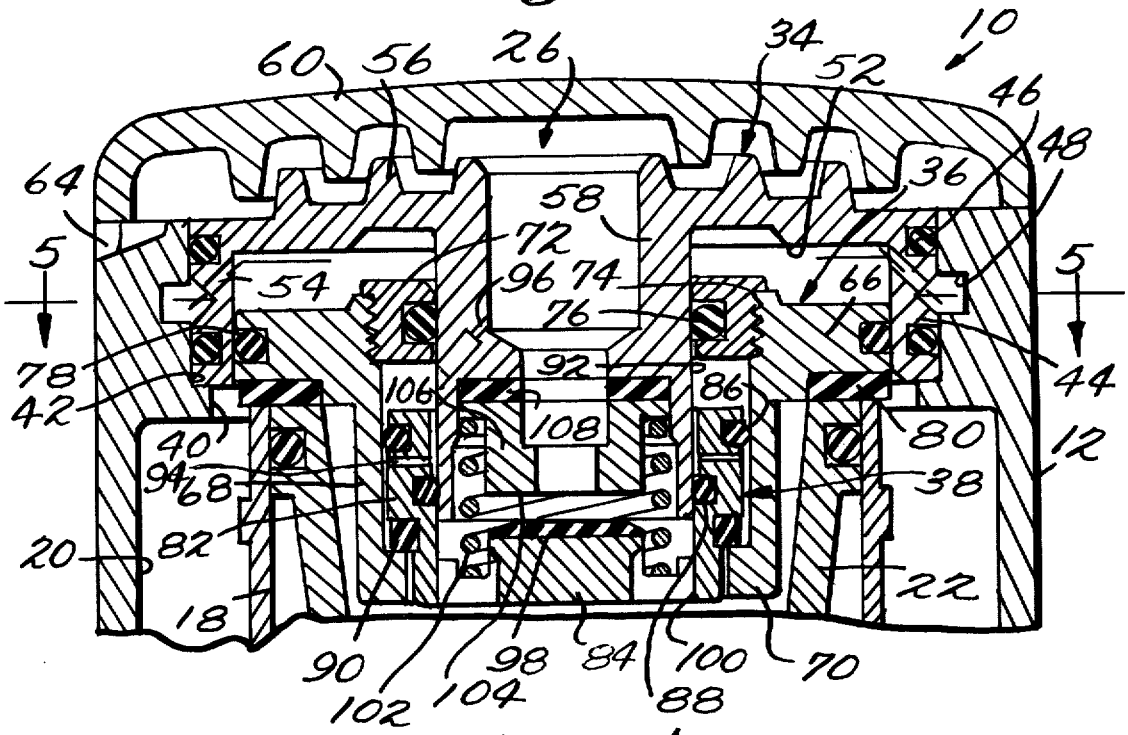
FIG. 2 is an enlarged fragmentary vertical sectional view showing the improved main valve assembly of the present invention in a position in which the inlet is closed and the outlet is open.
Figure 3:
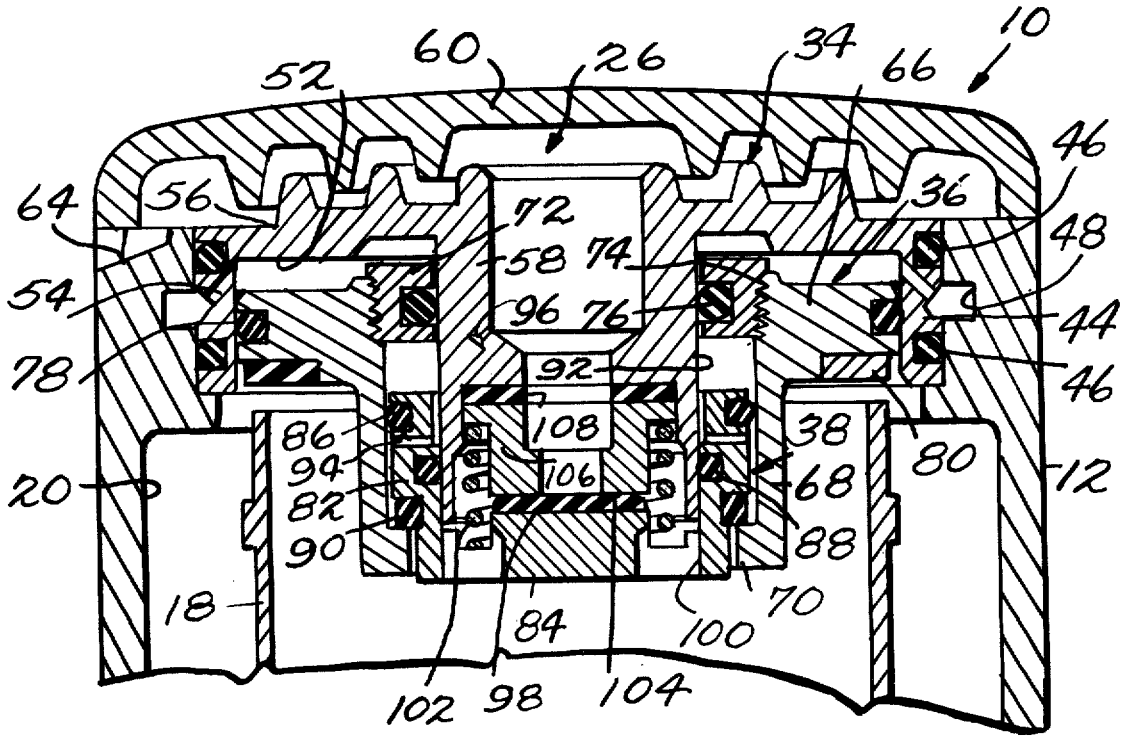
FIG. 3 is a view similar to FIG. 2 showing the simultaneous movement of the main valve assembly into a position opening the inlet and closing the outlet.
Figure 4:
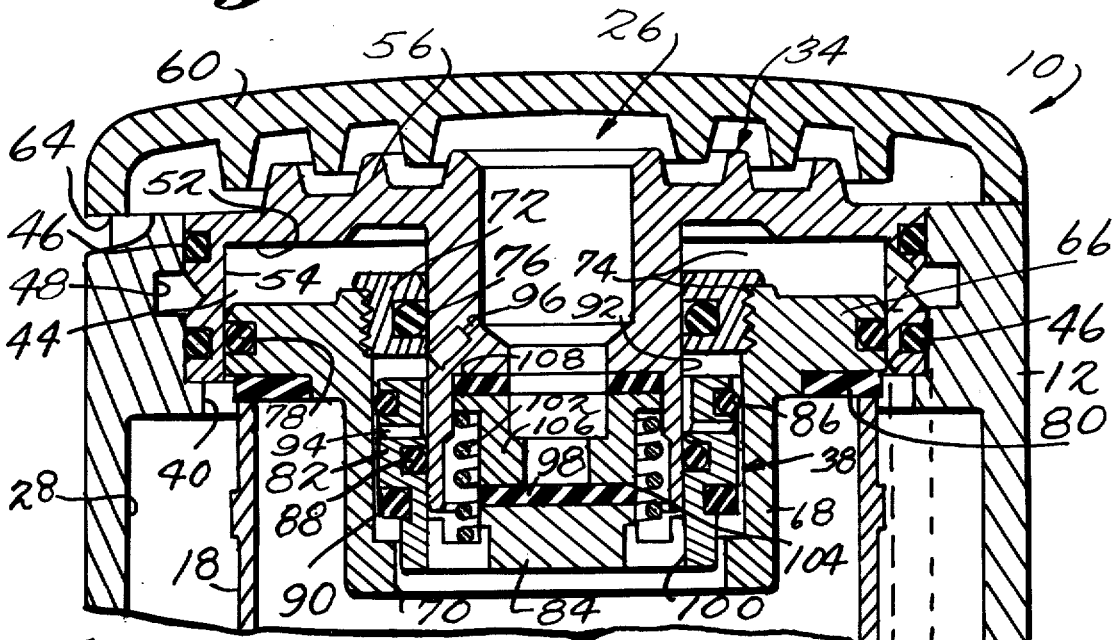
FIG. 4 is a view similar to FIG. 2 showing the first sequence of operation in which the inlet is closed prior to the opening of the outlet.
Figure 5:
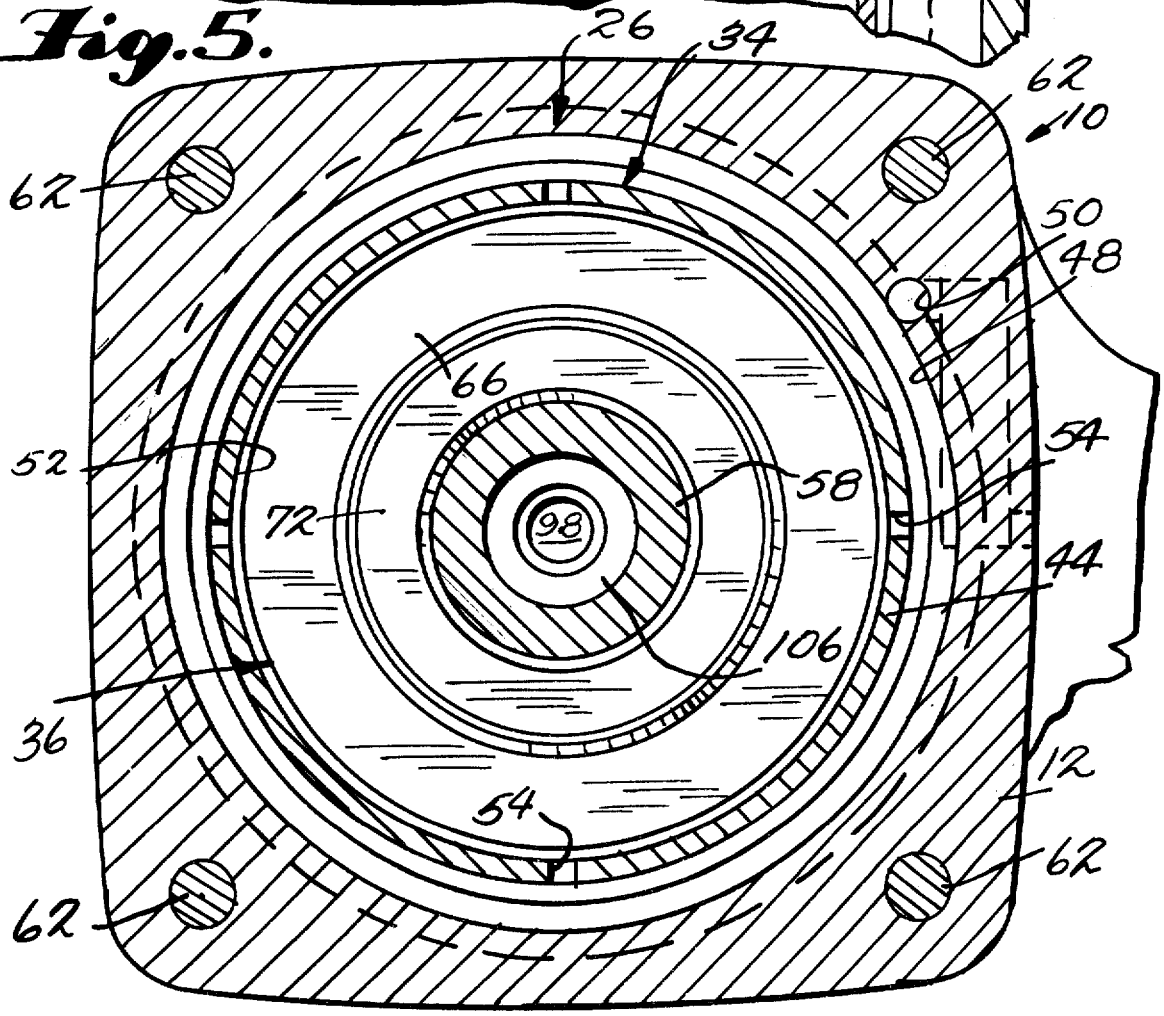
FIG. 5 is a sectional view taken along the line 5—5 of FIG. 2.

Referring now more particularly to FIGS. 2-4, the improved main valve assembly 26 includes three basic components: namely, a main fixed insert structure, generally indicated at 34; a main inlet valve structure, generally indicated at 36; and a main outlet valve structure, generally indicated at 38. The upper end of the housing 12 is formed with a vertical opening 40 communicating with the reservoir 20 having a counterbore 42 formed in the upper end thereof. The fixed insert structure 34 includes a member having an outer depending cylindrical portion 44 adapted to engage within the counterbore 42. The outer periphery of the cylindrical portion 44 includes a pair of vertically spaced annular grooves receiving therein a pair of annular O-ring seals 46. The seals 46 engage the wall of the counterbore 42 above and below an annular groove 48 formed in the housing. As best shown in FIGS. 1, 5 and 6, the annular groove 48 cooperates with a vertical bore 50 to communicate pilot pressure controlled by pilot valve 32 with the main valve assembly 26.

Pilot pressure within the annular groove 48 is communicated with a pilot pressure chamber 52 through a series of annularly spaced openings 54 extending through the cylindrical portion 44 between the seals 46. The pilot pressure chamber 52 is annular in configuration and is defined along its outer periphery by the interior of the cylindrical portion 44. Extending radially inwardly from the upper end of the cylindrical portion 44 is an annular wall portion 56, the lower surface of which defines the upper end of the annular pilot pressure chamber 52. The inner periphery of the pilot pressure chamber is defined by the exterior of an inner hollow cylindrical portion 58 extending downwardly from the inner periphery of the wall portion 56.

The member which includes the portions 44, 56 and 58 is fixedly retained in the housing counterbore 42 by a cap member 60 suitably removably bolted to the housing 12, as indicated at 62 in FIG. 5. The cap member 60 includes annular spaced portions (not shown) which overlie and engage spaced outer peripheral sections of the wall portion 56 to effect the aforesaid fixed retention. The interior surface of the cap member 60 and opposed surface of the wall portion include a series of interrelated annular baffles which serve to dissipate the discharge air pressure directed through the openings 64 in the front portion of the housing 12.

The inlet valve structure 36 includes an annular member having an outer radially extending portion 66 and an inner cylindrical portion 68 terminating at its lower end in a radially inwardly directed annular flange 70. A separate annular member 72 is sealingly threaded within the upper end of the cylindrical portion 68 as indicated at 74. An inner O-ring seal 76 is mounted in an interior annular groove in the member 72 and an outer O-ring seal 78 is mounted in an exterior annular groove in the outer portion 66. The seals 76 and 78 and the upper surfaces of the inlet valve structure extending therebetween define the lower end of the pilot pressure chamber 52. The inlet valve structure 36 thus serves as a valve member movable between open and closed positions in response to variations in pilot pressure. The closed position of the inlet valve structure 36 is shown in FIGS. 1, 2 and 4 and it will be noted that a resilient annular pad-like valve element 80 is carried along the lower outer surface of the portion 66 in a position to engage the upper end of the cylinder 18.

The outlet valve structure 38 includes a member having an outer tubular portion 82 and a lower central disk-like portion 84. The upper end of the tubular portion 82 is formed with an exterior peripheral groove which receives an O-ring seal 86 engaging the cylindrical interior surface of the cylindrical portion 68 of the inlet valve structure 36. Formed in the interior peripheral of the tubular portion 82 spaced below the O-ring seal 86 is a periphery groove receiving a second O-ring seal 88 engaging the exterior cylindrical surface of the cylindrical portion 58 of the fixed valve structure 34.

Mounted in the exterior periphery of the tubular portion 82 below the second O-ring seal 88 is a resilient annular valve element 90 cooperable with the annular flange 70 of the inlet valve structure 36. The exterior periphery of the tubular portion 82 below the valve element 90 is of a size less than the interior size of the flange 70 so as to communicate the air pressure condition within the cylinder 18 above the piston 22 to the valve element 90 and radially outwardly past the valve element 90 when the latter is spaced from the flange 70 as shown in FIG. 4. The valve element 90 thus serves to control the communication of the cylinder pressure to a delay chamber 92 defined by the interior surface of portion 68, the exterior surface of portion 58, the member 72 and its seal 76 and the two seals 86 and 88 carried by the portion 82. In order to communicate the cylinder pressure to the delay chamber 92 under the control of valve element 90, a series of annularly spaced openings 94 extend through the portion 82 between the seals 86 and 88. Delay chamber 92 is restrictingly communicated with the atmosphere as by a restricted passage 96 extending through the fixed valve portion 58.

The outlet valve structure 38 includes a main outlet valve element 98 which is in the form of a resilient disk-shaped pad fixed to the upper central surface of the valve member portion 84. In order to communicate the cylinder pressure to the valve element a series of annularly spaced axial openings 100 are formed in the portion 84. The outlet valve structure 38 is normally resiliently urged, as by a coil spring 102, into an open position wherein valve element 98 is disposed in spaced relation to a downwardly facing annular valve seat 104 provided by the fixed valve structure 34. While the valve seat 104 could be integral with the portion 58, for purposes of better tolerance and fit, the valve seat is formed on a separate exteriorly flanged sleeve member 106. As shown, the upper end of the coil spring 102 seats against the flange of the member 106 so as to resiliently urge the same into engagement with a resilient washer 108 which, in turn, seats on the lower interior surface of a counterbore in the bottom of the portion 58.

OPERATION

Before undertaking to describe the operation of the main valve assembly 26, it is pertinent to note the manner in which the inlet valve structure 36, outlet valve structure 38 and fixed valve structure 34 are assembled within the housing 12. Assembly is initiated by engaging the outlet valve structure 38 downwardly within the cylindrical portion 68 of the inlet valve structure 36. Member 72 is then threadedly engaged within the upper end of the portion 68 thus retaining the outlet valve structure between the flange 70 and the member 72. These two assembled structures are then engaged within the open upper end of the housing into a position wherein the main inlet valve element 80 engages the upper end of the cylinder 18. The main fixed member of the fixed valve structure is then moved into the open upper end of the housing until it is engaged in the position shown in FIG. 2. Finally, cap member 60 is mounted above the main fixed member and secured to the housing 12 as by bolts 62.

It will be noted that when the housing 12 is connected with a source of air under pressure (as by air hose or the like leading to the end of the handle of the housing, which defines a portion of the reservoir 20), this pressure will communicate through the pilot valve 32, bore 50, groove 48, and openings 54 into the pilot pressure chamber 52. In this way reservoir pressure is normally communicated to the pilot pressure chamber 52, which pilot pressure acts upon the pressure area of the inlet valve structure defined between the annular seals 76 and 78 to bias the inlet valve structure 36 into the closed position shown in FIGS. 2 and 4 wherein the valve element 80 engages the upper end of the cylinder 18. It will be noted that a very slight peripheral portion of the inlet valve structure disposed outwardly of the exterior of the cylinder and inwardly of the exterior of the annular seal 78 is at all times exposed to the pressure within the reservoir 20. However, since this annular area is considerably less than the pressure responsive surface area of the inlet valve structure communicating with the pilot pressure chamber 52, the inlet valve structure 36 will be maintained in its closed position by the pilot pressure. It will also be noted that coil spring 102 acts the bias the outlet valve structure 38 into a position which is shown in FIG. 2 wherein the valve element 90 engages the annular flange 70 of the inlet vale member 36 and hence spring 102 also serves to resiliently bias the inlet valve structure into its closed position. It will also be noted that when the valve element 90 of the outlet valve structure is disposed in engagement with the annular flange 70 of the inlet valve structure when the latter is in its closed position, valve element 98 of the outlet valve structure is disposed in its open position with respect to valve seat 104 communicating the cylinder 18 above the piston 22 to the atmosphere ultimately through discharge opening 64.

The operation of the main valve assembly 26 to effect the drive stroke of the piston 22 and fastener driving element 24 carried thereby is initiated by the operator digitally actuating the trigger 28 and moving the device 10 into engagement with a workpiece which moves contact trip element 30. When the trigger 28 and contact trip 30 have both been moved, the pilot valve 32 is moved into a position to dump the pressure in the pilot pressure chamber 52 to atmosphere. When the pressure within the pilot pressure chamber 52 is relieved, the reservoir pressure acting on the outer peripheral area of the inlet valve structure is sufficient to overcome the bias of spring 102 and move inlet valve structure 36 upwardly, thus disengaging the valve element 80 from the end of the cylinder 18. As soon as the valve element 80 is lifted off of the upper end of the cylinder full reservoir pressure can now act on the entire lower surface area of the inlet valve structure, thus resulting in a rapid upward movement of the latter into the open position shown in FIG. 3. During this movement, since the annular flange 70 is in engagement with the valve element 90 of the outlet valve structure 38, the latter will be moved upwardly with the inlet valve structure 36 against the bias of spring 102 into the closed position shown in FIG. 3 wherein the valve element 98 engages the seat 104 thus closng off communication of the cylinder with the atmosphere. The above rapid communication of reservoir pressure to the upper end of the cylinder will effect a rapid and efficient drive stroke of the piston 22 which, in turn, moves the fastener driving element 24 through the drive track 14 to engage the fastener fed laterally therein from the magazine 16 outwardly into the workpiece.

It will be understood that the operation of the main valve assembly 26 is essentially independent of the manner in which the return stroke of the piston is effected. With the differential piston arrangement shown in FIG. 1, the return stroke is effected by reservoir pressure, communicating at all times with the differential piston 22, as soon as reservoir pressure acting on the upper end of the piston is relieved. It will be understood that other types of returns, such as plenum chamber returns, may be utilized if desired.

With the arrangement shown, the return stroke is initiated by the disengagement of either the contact trip 30 or trigger 28 or both. Here again, it will be understood that the valve assembly 26 is not dependent upon actuation of this sort but will function with other types of actuation, such as full one-cycle actuators or automatic cycle actuators. With the arrangement shown, the disengagement of either the trigger 28 or contact trip element 30 will reverse the pilot pressure valve 32 thus again communicating the pilot pressure chamber 52 with the reservoir 20.

With reference to FIG. 3, it will be noted that prior to the communication of reservoir pressure with the pilot pressure chamber 52, reservoir pressure is acting upwardly on the inlet valve structure 36 throughout an annular area which extends between the inner periphery of the annular flange 70 and the exterior periphery of the O-ring seal 78. This area, however, is less than the area between the seals 78 and 76 which define the pressure responsive surface area of the inlet valve structure within the pilot pressure chamber. Consequently, when the pilot pressure chamber 52 is communicated with reservoir pressure, the inlet valve structure 36 will be biased to move downwardly. However, since reservoir air pressure within the cylinder is initially acting on the outlet valve structure 38 through a pressure area equal to the diameter of the valve element 98 in engagement with valve seat 104 and the annular area between the inner periphery of seal 88 and the exterior of the valve element 90 in engagement with the annular flange 70, the outlet valve structure 38 will be maintained in its closed position during the initial downward movement of the inlet valve structure 36. In this regard, it will be understood that the strength of spring 102 is not sufficient to overcome the pressure bias acting on the outlet valve structure areas indicated above.

As the inlet valve structure 36 moves downwardly toward its closed position, annular flange 70 moves downwardly away from valve element 90 thus permitting the reservoir pressure within the cylinder 18 to communicate upwardly along the interior periphery of the outlet valve portion 82 and exterior radially outwardly past thevalve element 90, axially upwardly to the passages or openings 94 and radially inwardly into the delay chamber 92. Restriction 96 permits the reservoir pressure within the upper end of the cylinder thus communicated with the delay chamber 92 to build up therein thus equalizing or tending to equalize the pressure acting on the outer annular portion 82 of the outlet valve structure as aforesaid. Spring 102 is chosen so that its strengthh is sufficient to overcome the force created by reservoir pressure acting on the surface area of the outlet valve element 98. Consequently, as soon as the pressure within the delay chamber has reached an equalization pressure or nearly so, spring 102 will act to move the outlet valve structure 38 downwardly. This movement normally will not occur unil after the valve element 80 of the inletvalve structure 36 has engaged the upper end of the cylinder 18 as is clear from the position of the parts shown in FIG. 4. As the valve element 98 moves off of the valve seat 104, the pressure areas acting on the outlet valve structure are now pressure equalized so that the bias of spring 102 will effect a rapid movement of the outlet valve structure into the open position as shown in FIG. 2. The movement of the outlet valve structure 38 into its open position wherein valve element 90 engages the annular flange 70 has the effect of trapping any pressure which has been communicated with the delay chamber 92. Restriction 96 will, however, permit the relief of such pressure.

It can thus be seen that the main valve assembly 26 is operable to enable a return stroke in such a way that the source of air pressure provided by the reservoir 20 is closed off by the engagement of valve element 80 before the pressure within the cylinder is communicated with the atmosphere by the disengagement of the valve element 98 with the valve seat 104. This sequential actuating insures against any loss of pressure which has heretofore been occasioned by the opening of the cylinder to the atmosphere before effecting the actual closing off of the cylinder to the reservoir. This advantageous saving in the air utilized is accomplished without any corresponding lag in the initiation of the drive stroke since a reverse sequential operation of first closing the outlet and then opening the inlet is not required. Rather, during initiation the inlet valve is opened immediately and simultaneously with the movement of the outlet valve into a closed position.

It thus will be seen that the object of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims. What is claimed is:

1. A pneumatically operated fastener driving device comprising a housing defining a fastener drive track, fastener magazine means for feeding successive fasteners laterally into said drive track, a fastener driving element slidably mounted in said drive track for movement through an operative cycle including a drive stroke during which a fastener within said drive track is engaged and moved longitudinally outwardly of the drive track into a workpiece and a return stroke and pneumatic means for effecting the operation of successive cycles of said fastener driving element, said pneumatic means including a drive piston connected with said fastener driving element, a cylinder within which said piston is reciprocably mounted, an air pressure reservoir communicating exteriorly with one end of said cylinder, means defining a discharge outlet port and pilot pressure operated main valve means for communicating the reservoir pressure with the interior of said one end of said cylinder to move the piston in a direction to effect the drive stroke of the fastener driving element and for communicating the one end of said cylinder with said outlet port for permitting the piston to move in a direction to effect the return stroke of the fastener driving element, the improvement in combination therewith which comprises said main valve means including an inlet valve structure having a pilot pressure responsive surface area, means mounting said inlet valve structure for movement between a closed position with respect to said one end of said cylinder and an open position communicating the air pressure reservoir therewith in response to the establishment of different pilot pressure conditions in communication with said pilot pressure responsive surface area, an outlet valve structure movable between a closed position with respect to said one cylinder end and said outlet port and an open position with respect to said one cylinder end and said outlet port and an open position with respect to said one cylinder end and said outlet port, and means operatively associated with said outlet valve structure for effecting (1) a movement of said outlet valve structure from the open position thereof to the closed position thereof simultaneously with a movement of said inlet valve structure from the closed position thereof to the open position thereof and (2) a movement of said outlet valve structure from the closed position thereof to the open position thereof sequentially following a movement of said inlet valve structure from the open position thereof to the closed position thereof.

2. A pneumatically operated fastener driving device comprising a housing defining a fastener drive track, fastener magazine means for feeding successive fasteners laterally into said drive track, a fastener driving element slidably mounted in said drive track for movement through an operative cycle including a drive stroke during which a fastener within said drive track is engaged and moved longitudinally outwardly of the drive track into a workpiece and a return stroke and pneumatic means for effecting the operation of successive cycles of said fastener driving element, said pneumatic means including a drive piston connected with said fastener driving element, a cylinder within which said piston is reciprocably mounted, an air pressure reservoir communicating exteriorly with one end of said cylinder, pilot pressure operated main valve means for communicating the reservoir pressure with the interior of said one end of said cylinder to move the piston in a direction to effect the drive stroke of the fastener driving element and for communicating the one end of said cylinder with atmosphere for permitting the piston to move in a direction to effect the return stroke of the fastener driving element, the improvement in combination therewith which comprises said main valve means including:

an annular structure fixed with respect to said housing providing (1) an outlet port concentric with said cylinder disposed adjacent to and outwardly of said one end thereof (2) an exterior cylindrical surface of a size less than said cylinder, (3) an interior cylindrical surface of a size greater than said cylinder, and (4) an annular surface facing toward said cylinder end extending between said exterior and interior cylindrical surfaces, a cylinder inlet valve structure having sealed sliding connections with said exterior and interior cylindrical surfaces and a pressure surface area defining with the annular surface extending between said exterior and interior cylindrical surfaces a pilot pressure chamber, said inlet valve structure having an annular valve element engageable with said one end of said cylinder when said pilot pressure chamber is pressurized and said inlet valve structure is in a closed position, said inlet valve structure being movable from said closed position to an open position when said pilot pressure chamber is communicated with the atmosphere, an outlet valve structure having an annular valve element engageable with said outlet port when said outlet valve structure is disposed in a closed position, spring means biasing said outlet valve structure into an open position, said outlet valve structure having a first pressure area facing in a direction opposed to the direction of spring bias exposed to the pressure in said cylinder in any position of movement of said outlet valve structure and a second pressure area of a size generally equal to the first pressure area facing in a direction opposed to the direction in which said first pressure area faces, means for restrictingly communicating said second pressure area with said outlet port downstream of the position of closure thereof by said outlet valve element, and means for (1) moving said outlet valve structure from its open position into its closed position in response to the movement of said inlet valve structure from its closed position to its open position, (2) maintaining said outlet valve structure in its closed position so long as said inlet valve structure is in its open position, and (3) communicating the pressure within said one end of said cylinder with said second pressure area in response to the movement of said inlet valve structure from its open position into its closed position whereby the pressure balancing of said first and second pressure areas permits said spring means to effect movement of said outlet valve structure from its closed position to its open position at a time after the inlet valve structure has been moved into its closed position.

3. A pneumatically operated fastener driving device as defined in claim 2 wherein said annular structure includes an annular member including inner and outer cylindrical portions defining said exterior and interior cylindrical surfaces respectively, said outer cylindrical portion having vertically spaced annular grooves formed in the exterior periphery thereof, a pair of O-ring seals within said grooves, said seals engaging cooperating peripheral surfaces on said housing.

4. A pneumatically operated fastener driving device as defined in claim 3 wherein said inlet valve structure includes a first annular member having an inner cylindrical portion terminating at its lower end in a radially inwardly extending annular flange, and a second annular member detachably sealingly engaged with said first member along the upper inner periphery of said inner cylindrical portion and extending radially inwardly thereof.

5. A pneumatically operated fastener driving device as defined in claim 4 wherein said last-mentioned means includes an annular control valve element carried by said outlet valve structure for movement therewith toward and away from the upper surface of said annular flange so as to prevent communication of the pressure within said one end of said cylinder with said second pressure area when engaged therewith and to permit said communication when spaced therefrom.

6. A pneumatically operated fastener driving device as defined in claim 5 wherein said outlet valve structure includes an annular member having an outer tubular portion, said control valve element being carried in the exterior periphery of said outer tubular portion, said outer tubular portion having an exterior annular groove above said control valve element, a series of annularly spaced radially extending passages between said exterior annular groove and said control valve element and an interior annular groove between said passages and said control valve element, an exterior O-ring seal in said exterior annular groove engaging the interior periphery of said inner cylindrical portion of said first member of said inlet valve structure, and an interior O-ring seal in said interior groove engaging the exterior periphery of the inner cylindrical portions of the annular member of said fixed structure.

7. A pneumatically operated fastener driving device as defined in claim 6 wherein said fixed structure includes a sleeve having an exterior annular flange on its upper end, a resilient washer between the upper end of said sleeve and said fixed annular structure, said spring means comprising a coil spring having its upper end engaging the exterior flange of said sleeve, the lower end of said sleeve defining said outlet port.

8. A pneumatically operated fastener driving device as defined in claim 2 wherein said inlet valve structure includes a first annular member having an inner cylindical portion terminating at its lower end in a radially inwardly extending annular flange, and a second annular member detachably sealingly engaged with said first member along the upper inner periphery of said inner cylindrical portion and extending radially inwardly thereof.

9. A penumatically operated fastener driving device as defined in claim 8 wherein said last-mentioned means includes an annular control valve element carried by said outlet valve structure for movement therewith toward and away from the upper surface of said annular flange so as to prevent communication of the pressure within said one end of said cylinder with said second pressure area when engaged therewith and to permit said communication when spaced therefrom.

10. A pneumatically operated fastener driving device as defined in claim 2 wherein said fixed structure includes a sleeve having an exterior annular flange on its upper end, a resilient washer between the upper end of said sleeve and said fixed annular structure, said spring means comprising a coil spring having its upper end engaging the exterior flange of said sleeve, the lower end of said sleeve defining said outlet port.

* * * * *